US009027757B2

(12) United States Patent
Pedain et al.

(10) Patent No.: US 9,027,757 B2
(45) Date of Patent: May 12, 2015

(54) MIXTURE OF AN AMINE ALKOXYLATE ESTER AND A QUATERNARY AMMONIUM COMPOUND AS A COLLECTOR FOR MINERALS CONTAINING SILICATE

(75) Inventors: Klaus-Ulrich Pedain, Dietzenbach-Steinberg (DE); Uwe Dahlmann, Mainz (DE)

(73) Assignee: Clariant Finance (BVI) Limited, Tortola (VG)

( * ) Notice: Subject to any disclaimer, the term of this patent is extended or adjusted under 35 U.S.C. 154(b) by 1008 days.

(21) Appl. No.: 13/126,303

(22) PCT Filed: Oct. 6, 2009

(86) PCT No.: PCT/EP2009/007147

§ 371 (c)(1),
(2), (4) Date: Apr. 27, 2011

(87) PCT Pub. No.: WO2010/051895

PCT Pub. Date: May 14, 2010

(65) Prior Publication Data

US 2011/0203975 A1 Aug. 25, 2011

(30) Foreign Application Priority Data

Nov. 7, 2008 (DE) ..... 10 2008 056 338

(51) Int. Cl.
*B03D 1/02* (2006.01)
*B03D 1/01* (2006.01)

(52) U.S. Cl.
CPC ..... *B03D 1/01* (2013.01); *B03D 2203/06* (2013.01); *B03D 2203/04* (2013.01); *B03D 1/02* (2013.01); *B03D 1/011* (2013.01)

(58) Field of Classification Search
CPC ..... B03D 1/02; B03D 1/0043; B03D 1/011; B03D 2203/04; B03D 2203/06
USPC ..... 209/166; 252/61; 554/104, 105, 107
See application file for complete search history.

(56) References Cited

U.S. PATENT DOCUMENTS

| | | | | | |
|---|---|---|---|---|---|
| 2,878,273 | A | * | 3/1959 | Conbere et al. | 554/91 |
| 2,970,158 | A | * | 1/1961 | Levis, Jr. | 554/105 |
| 3,915,867 | A | * | 10/1975 | Kang et al. | 510/525 |
| 4,276,156 | A | * | 6/1981 | Hefner, Jr. | 209/166 |
| 4,278,533 | A | * | 7/1981 | Hefner, Jr. | 209/166 |
| 4,305,815 | A | * | 12/1981 | Hefner, Jr. | 209/166 |
| 4,474,619 | A | * | 10/1984 | Meyer et al. | 209/166 |
| 4,678,562 | A | | 7/1987 | Keys | |
| 4,701,257 | A | | 10/1987 | Hefner | |
| 4,838,533 | A | * | 6/1989 | Buchler | 269/310 |
| 4,995,965 | A | | 2/1991 | Mehaffey et al. | |
| 5,152,916 | A | | 10/1992 | Hoffmann et al. | |
| 5,720,873 | A | | 2/1998 | Klingberg et al. | |
| 6,211,139 | B1 | * | 4/2001 | Keys et al. | 510/504 |

FOREIGN PATENT DOCUMENTS

| | | | |
|---|---|---|---|
| CA | 1187212 | | 4/1982 |
| EP | 293955 | A2 * | 12/1988 |
| EP | 643038 | A2 * | 3/1995 |
| EP | 739976 | A1 * | 4/1996 |
| EP | 1949964 | | 7/2008 |
| WO | WO 89/09204 | A1 * | 10/1989 |
| WO | WO 92/18685 | A1 * | 10/1992 |
| WO | WO 9726995 | A1 * | 7/1997 |
| WO | WO 00/62937 | | 10/2000 |
| WO | WO 01/77434 | A2 * | 10/2001 |

OTHER PUBLICATIONS

International Search Report for PCT/EP2009/0007147, dated Feb. 12, 2010.
Translation of the International Preliminary Report on Patentability for PCT/EP2009/007147, dated May 19, 2011.
Papini, R.M. et al, "Cationic flotation of iron ores: amine characterization and performance", Minerals and Metallurgical Processing, Co, vol. 18, No. 1, Jan. 1, 2001, pp. 5-9.
English abstract for CA 1187212, Apr. 23, 1982.

* cited by examiner

*Primary Examiner* — Thomas M Lithgow
(74) *Attorney, Agent, or Firm* — Tod A. Waldrop

(57) ABSTRACT

The invention relates to the use of a composition of A) at least one quaternary ammonia compound comprising at least one organic radical bonded to the ammonia nitrogen atom and optionally comprising heteroatoms and having 1 to 36 carbon atoms, and B) at least one amine alkoxylate ester of formula (1) or a salt thereof, (1)

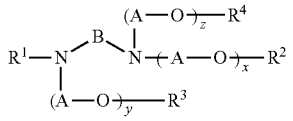

where A, B are, independently of each other, a $C_2$- through $C_5$-alkylene radical $R^1$, a $C_8$- through $C_{24}$-alkyl radical or alkenyl radical $R^2$, $R^3$, $R^4$ independent of each other, H, or a $C_8$- through $C_{24}$-acyl radical, with the stipulation that at least one of the radicals $R^2$, $R^3$ or $R^4$ stands for a $C_8$- through $C_{24}$-acyl radical, and x, y, z, independently of each other, stand for a whole number from 0 through 50, with the stipulation that x+y+z is a whole number from 1 through 100, in quantities of 10 through 5000 g/tonne of ore as a collector in silicate floation.

16 Claims, No Drawings

MIXTURE OF AN AMINE ALKOXYLATE ESTER AND A QUATERNARY AMMONIUM COMPOUND AS A COLLECTOR FOR MINERALS CONTAINING SILICATE

The present invention relates to the use of compositions of alkylammonium salts and amine alkoxylate esters in the refining by flotation of minerals and ores containing silicate.

In reverse flotation, impurities are floated out of the mineral of value. In particular, iron ore, calcium carbonate, phosphate and feldspar are frequently refined in this manner. In many cases, minerals containing silicates are the main component of these impurities, which cause reductions in quality of the end product. In addition to quartz, mica and feldspar, these also include muscovite and biotite. For example, a high silicate content reduces the quality of iron ore concentrate and so this concentrate is purified by flotation, for example in Brazil, by using alkyl ether amines and alkyl ether diamines, in order to be able to produce high-value steels from the low-silicate concentrate.

Calcium carbonate is purified from silicate-containing and coloring minerals using quaternary ammonium salts based on fatty acids or fatty alkyl imidazoline compounds. Since calcium carbonate, in addition to kaolin, rutile and talc is used as a white pigment in papermaking and plastics production, a degree of whiteness as high as possible or a low concentration of coloring minerals is desirable. Owing to the hardness of silicate, in papermaking, this would also lead to increased wear on the calenders of the papermaking machines. Therefore, calcium carbonate, in addition to dry refining, is purified by the flotation process.

In general, attempts are made by means of reverse flotation to reduce the silicate content, which in the case of calcium carbonate is frequently characterized as acid-insoluble component, below 1.0% by weight. The silicate content in the feed can vary and can sometimes be 10 to 20% by weight.

As silicate collectors, for example fatty amines, alkyl ether amines, alkyl ether diamines or quaternary ammonium salt compounds are used. These are also known under the trade name Flotigam®.

In WO-A-00/62937, the use of quaternary ammonium salts for the flotation of iron ore is disclosed.

EP-A-0 876 222 describes the use of biodegradable esterquats as collector for the flotation of non-sulfidic ores.

U.S. Pat. No. 4,995,965 discloses the use of hydroxypropylated quaternary ammonium salts, unsymmetrically substituted dimethyldialkylammonium salts and dialkylhexahydropyrimidine compounds as collectors in the reverse flotation of calcium carbonate.

CA-A-1 187 212 discloses quaternary ammonium salts and bisimidazolines as collectors in silicate flotation.

U.S. Pat. No. 5,720,873 discloses a collector for silicate flotation, which collector, in addition to a quaternary ammonium compound, comprises an amine alkoxylate.

The collectors for silicate flotation that are described in the prior art, however, exhibit inadequate results with respect to selectivity and yield. The object of the present invention was therefore to provide an improved collector for silicate flotation, which improved collector can be used, in particular in reverse flotation, but also in direct flotation.

Surprisingly, it has been found that a collector combination of an alkylammonium salt and an amine alkoxylate ester delivers less calcite fine grain than the previously described collectors and collector combinations and the yield of valuable material is thereby significantly improved without the content of silicates in the concentrate thereby being increased.

The invention relates to the use of a composition of

A) at least one quaternary ammonium compound which contains at least one organic radical having 8 to 36 carbon atoms that is bound to the ammonium nitrogen atom and possibly contains heteroatoms, and B) at least one amine alkoxylate ester of the formula (1) or a salt thereof (1)

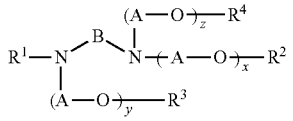

where

A, B independently of one another are a $C_2$ to $C_5$ alkylene radical $R^1$ is a $C_8$ to $C_{24}$ alkyl radical or $C_8$ to $C_{24}$ alkenyl radical $R^2$, $R^3$, $R^4$ independently of one another are H or a $C_8$ to $C_{24}$ acyl radical, with the proviso that at least one of the radicals $R^2$, $R^3$ or $R^4$ is a $C_8$ to $C_{24}$ acyl radical x, y, z independently of one another are an integer from 0 to 50 with the proviso that x+y+z is an integer from 1 to 100, in amounts of 10 to 5000 g/metric ton of ore as collector in silicate flotation.

The invention further relates to a process for the flotation of silicate-containing mineral, by bringing a composition of A) and B) into contact with the silicate-containing mineral.

The invention further relates to a composition containing 1 to 99% by weight of the component A) and 1 to 99% by weight of the component B).

The composition of A) and B) is hereinafter also termed the collector according to the invention.

Preferably, the quaternary ammonium compound which makes up the component A) is a tetraalkylammonium salt of the formula (2)

(2)

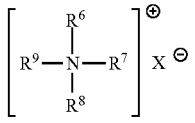

where $R^6$, $R^7$ independently of one another are $C_1$ to $C_6$ alkyl groups or benzyl groups, $R^8$, $R^9$ independently of one another are $C_8$ to $C_{36}$ alkyl groups or $C_8$ to $C_{36}$ alkenyl groups and X is an anion.

Esterquats corresponding to the formula (3) are further preferred embodiments of the quaternary ammonium compound according to component A), (3)

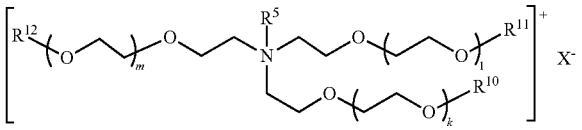

where $R^{10}$, $R^{11}$, $R^{12}$ independently of one another are H or $C_8$ to $C_{24}$ acyl groups, $R^5$ is a $C_1$ to $C_6$ alkyl group or a benzyl group, k, l, m are integers from 0 to 5, and X is an anion, preferably $C_1$ or $CH_3SC_4$.

$R^1$, $R^8$ and $R^9$, independently of one another, are a linear or branched alkyl or alkenyl group. Preferably, the radicals comprise 8 to 18 carbon atoms. Particular preference is given to 2-ethylhexyl, isononyl, isodecyl and isotridecyl and also dodecyl radicals.

$R^2$, $R^3$, $R^4$, $R^{10}$, $R^{11}$ and $R^{12}$ are acyl radicals having 8 to 24 carbon atoms. The acyl radicals preferably comprise 10 to 18 carbon atoms. They can be linear or branched. The acyl radicals can be saturated or unsaturated. Preferred acyl radicals are stearoyl and oleoyl radicals.

Component A) of the collector according to the invention contains at least one organic radical having 8 to 36 carbon atoms that is bound to the ammonium nitrogen atom and possibly contains heteroatoms. The radical can preferably be an alkyl, alkenyl or acyl radical which is further preferably such as is disclosed for $R^1$ or $R^2$.

A in particular is either an ethylene (—$C_2H_4$—), a propylene (—$C_3H_6$—) or a butylene group (—$C_4H_8$—). Preferably, A is an ethylene group.

B is in particular either an ethylene (—$C_2H_4$—), a propylene (—$C_3H_6$—) or a butylene group (—$C_4H_8$—). Preferably, B is an isopropylene group.

k, l and m are preferably independently of one another 2, 3 or 4, in particular 3.

The sum of x, y and z preferably gives an integer from 15 to 30, in particular 20 to 25.

In a preferred embodiment, the aminoethoxylate ester which makes up the component B) is in the form of monoammonium or diammonium salts thereof which are obtained by neutralization not only with organic but also mineral acids.

The components A) and B) of the collector according to the invention can be used together with other collectors of the prior art which are different from A) and B). Examples of such further collectors which are different from A) and B) are $$R^{14}—O—R^{13}—NH_2 \quad (II)$$

where $R^{14}$ is a hydrocarbon group having 1 to 40, preferably 8 to 32, carbon atoms and $R^{13}$ is an aliphatic hydrocarbon group having 2 to 4 carbon atoms;

$$R^{17}—O—R^{15}—NH—R^{16}—NH_2 \quad (III)$$

where $R^{17}$ is a hydrocarbon group having 1 to 40, preferably 8 to 32, carbon atoms, $R^{15}$ and $R^{16}$ are one or several aliphatic hydrocarbon groups having 2 to 4 carbon atoms;

$$(R^{21}R^{18}NR^{19}R^{20})^+Y^- \quad (IV)$$

where $R^{21}$, $R^{18}$, $R^{19}$ and $R^{20}$ are one or several hydrocarbon groups having 1 to 22 carbon atoms and $Y^-$ is a suitable anion;

$$R^{22}—NH_2 \quad (V)$$

where $R^{22}$ is a hydrocarbon group having 1 to 40, preferably 8 to 32, carbon atoms;

$$R^{23}—N—[D\text{-}NH_2]_2 \quad (VI)$$

where $R^{23}$ is a linear or branched alkyl group or alkenyl group having 6 to 24 carbon atoms and D is a $C_2$ to $C_4$ alkylene group.

The use of the collector according to the invention can also proceed in combination with frothers and depressants, such as are known from the prior art. In order to avoid, in the silicate flotation from iron ore, this iron ore being co-discharged, preferably hydrophilic polysaccharides such as, for example, modified starch, carboxymethylcellulose, or gum Arabic, are added as depressants in doses of 10 to 1000 g/metric ton.

The silicate flotation is preferably carried out at a pH of 6 to 12, in particular 8 to 11, which is set, for example, using sodium hydroxide.

The use according to the invention can proceed either in direct or else reverse silicate flotation. The use according to the invention is also suitable for freeing silicate sand from impurities by separating the silicate sand from the impurities by flotation using the compound of the composition of A) and B).

The preferred amount of the collector according to the invention added is 100 to 1500 g/metric ton of ore, in particular 500 to 600 g/metric ton of ore.

The preferred weight ratio for the composition according to the invention and use according to the invention is A:B=99:1 to 1:99, in particular 20:80 to 80:20.

EXAMPLES

The laboratory flotation experiments were carried out using a Denver flotation machine type D 12 in a 2.5 l glass cell, wherein the pulp level was kept at a constant height by constant addition of drinking water. The pulp contained 130 g of solids per liter.

Example 1

Ground calcite, 100%<250 μm, which contained approximately 12% by weight of silicate minerals such as quartz, mica, and also graphite, was transferred to a 2.5 l glass cell. The flotation pulp was then adjusted with drinking water to a content of 130 g of solids per liter of pulp. The flotation pulp was conditioned and the subsequent flotation performed using a DENVER flotation machine, type D-12.

For flotation of the graphite, the flotation pulp was first conditioned using 20 g/t of a pine oil. The pine oil was added to the pulp undiluted and conditioned for 1 min.

The graphite was floated out in the froth phase (graphite flotation tailings). The flotation period was ended after 3 min.

The chamber product was then subjected to a silicate flotation, wherein the silicates were floated out in the froth phase (silicate flotation tailings). The purified calcite (concentration) remained in the flotation cell. The silicate collectors were added undiluted to the flotation pulp and conditioned for 1 min. The subsequent silicate flotation was ended after 4 min.

The flotation fractions (graphite flotation tailings, silicate flotation tailings and concentrate) were dewatered, dried, weighed and dissolved for determining the acid-insoluble proportion in 25% strength HCl solution. The acid-insoluble component (AIR) of the concentrate is a quality feature. The AIR content is calculated: %AIR=dried residue from the HCl solution/initial weight into the HCl solution×100%.

A further quality feature of the flotation concentrate is the degree of whiteness thereof, which was measured using a photometer against barite.

The collectors used and the flotation results achieved therewith are shown in the tables hereinafter.

The standard collectors used were dicocoalkyl dimethylammonium chloride (standard collector 1), dioleoyloxyethylhydroxyethylmethylammonium methosulfate (standard collector 2) and tallow fat propylenediamine containing 40 mol of EO (standard collector 3).

As an example of the collector according to the invention (collector 4), a mixture of dicocoalkyldimethylammonium chloride (standard collector 1, component A)) and ethoxylated cocoalkylpropylenediamine, esterified with oleic acid (A=ethylene, $R^1$=coconut fatty alkyl, $R^2$,$R^3$,$R^4$=oleic acid, x,y,z total 50, component B)) was used in various weight ratios according to table 3.

TABLE 1

| Example | Collector | Addition [g/t] | AIR [%] | Recovery [%] |
|---|---|---|---|---|
| 1 (C) | 1 | 404 | 1.98 | 89.5 |
| 2 (C) | 1 | 455 | 1.1 | 88.7 |
| 3 (C) | 1 | 500 | 0.51 | 87.8 |
| 4 (C) | 2 | 478 | 2.56 | 90.1 |
| 5 (C) | 2 | 577 | 1.50 | 88.4 |
| 6 (C) | 2 | 693 | 0.74 | 86.3 |

Standard collector 1 = dicocoalkyldimethylammonium chloride
Standard collector 2 = dioleoyloxyethylhydroxyethylmethylammonium methosulfate

TABLE 2

| Example | Collector | Addition [g/t] | Collector | Addition [g/t] | AIR [%] | Recovery [%] |
|---|---|---|---|---|---|---|
| 7 (C) | 1 | 500 | 3 | 0 | 0.51 | 87.8 |
| 8 (C) | 1 | 250 | 3 | 250 | 0.83 | 86.1 |
| 9 (C) | 1 | 350 | 3 | 150 | 0.52 | 87.2 |
| 10 (C) | 1 | 450 | 3 | 50 | 0.52 | 88.3 |
| 11 (C) | 1 | 0 | 3 | 500 | 1.32 | 84.5 |

Standard collector 1 = dicocoalkyldimethylammonium chloride
Standard collector 3 = tallow fat propylenediamine containing 40 mol of EO

TABLE 3

Use of the collector 4 according to the invention

| Example | Ratio A):B) | Addition [g/t] | AIR [%] | Recovery [%] |
|---|---|---|---|---|
| 12 (C) | 100:0 | 500 | 0.51 | 87.8 |
| 13 | 80:20 | 500 | 0.50 | 91.4 |
| 14 | 70:30 | 500 | 0.51 | 89.8 |
| 15 | 50:50 | 500 | 0.52 | 89.5 |
| 16 | 30:70 | 500 | 0.49 | 89.1 |
| 17 (C) | 0:100 | 500 | 1.62 | 84.0 |

AIR = Acid-Insoluble Residue

The results show that the standard collector gives a much lower calcite recovery compared with the collector according to the invention.

The invention claimed is:

1. A process for the refining of minerals and ores containing silicate by flotation, comprising adding a composition comprising A) at least one quaternary ammonium compound which contains at least one organic radical having 8 to 36 carbon atoms wherein the organic radical is bound to the ammonium nitrogen atom and possibly contains heteroatoms, and B) at least one amine alkoxylate ester of the formula (1) or a salt thereof (1)

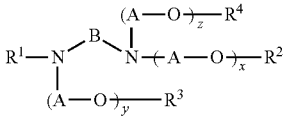

where

A, B independently of one another are a $C_2$ to $C_5$ alkylene radical $R^1$ is a $C_8$ to $C_{24}$ alkyl radical or $C_8$ to $C_{24}$ alkenyl radical $R^2$, $R^3$, $R^4$ independently of one another are H or a $C_8$ to $C_{24}$ acyl radical, with the proviso that at least one of the radicals $R^2$, $R^3$ or $R^4$ is a $C_8$ to $C_{24}$ acyl radical x, y, z independently of one another are an integer from 0 to 50 with the proviso that x+y+z is an integer from 1 to 100, in amounts of 10 to 5000 g/metric ton of ore to the silicate flotation.

2. A process as claimed in claim 1, wherein the ammonium compound A) is selected from the group consisting of tetraalkylammonium salts and esterquats.

3. A process as claimed in claim 2, wherein the tetraalkylammonium salt corresponds to the formula (2)

(2)

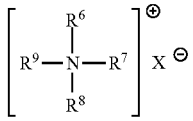

where $R^6$, $R^7$ independently of one another are $C_1$ to $C_6$ alkyl groups or benzyl groups, $R^8$, $R^9$ independently of one another are $C_8$ to $C_{36}$ alkyl groups or $C_8$ to $C_{36}$ alkenyl groups and X is an anion.

4. A process as claimed in claim 2, wherein the esterquat corresponds to the formula (3)

(3)

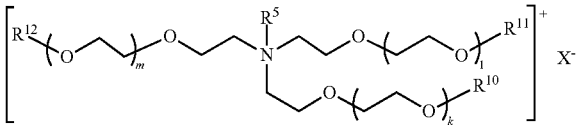

where $R^{10}$, $R^{11}$, $R^{12}$ independently of one another are H or $C_8$ to $C_{24}$ acyl groups, $R^5$ is a $C_1$ to $C_6$ alkyl group or a benzyl group, k, l, m independently of one another are integers from 0 to 5, and X is an anion.

5. A process as claimed in claim 1, wherein $R^1$, $R^2$, $R^3$, $R^4$, $R^8$, $R^9$, $R^{10}$, $R^{11}$ and $R^{12}$ independently of one another are selected from the group consisting of linear or branched alkyl, alkenyl and acyl radicals having 8 to 18 carbon atoms.

6. A process as claimed in claim 5, wherein $R^1$, $R^2$, $R^3$, $R^4$, $R^8$, $R^9$, $R^{10}$, $R^{11}$ and $R^{12}$ independently of one another are selected from 2-ethylhexane, isononane, isodecane, decane, dodecane or isotridecane radicals or the corresponding acyl radicals.

7. A process as claimed in claim 1, wherein A is an ethylene group (—$C_2H_4$—).

8. A process as claimed in claim 1, where k, l and m independently of one another are 2, 3 or 4.

9. A process as claimed in claim 1, where the sum of x, y and z is an integer from 15 to 30.

10. A process as claimed in claim 1, for reverse flotation of silicate-containing minerals from iron ore, phosphate ore or calcium carbonate.

11. A process as claimed in claim 1, for purifying silicate sand.

12. A process as claimed in claim 1, further comprising adding frothers and depressants.

13. A process as claimed in claim 1, wherein the process is performed in a pH range of 7 to 12.

14. A process as claimed in claim 1, wherein the composition comprising A) and B) is added in amounts of 0.1 to 1.5 kg per metric ton of ore.

15. A composition containing

A) at least one quaternary ammonium compound which contains at least one organic radical having 1 to 36 carbon atoms wherein the at least one organic radical is bound to the ammonium nitrogen atom and possibly contains heteroatoms, and B) at least one amine alkoxylate ester of the formula (1) or a salt thereof

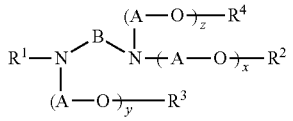

(1)

where

A, B independently of one another are a $C_2$ to $C_5$ alkylene radical $R^1$ is a $C_8$ to $C_{24}$ alkyl radical or $C_8$ to $C_{24}$ alkenyl radical $R^2$, $R^3$, $R^4$ independently of one another are H or a $C_8$ to $C_{24}$ acyl radical, with the proviso that at least one of the radicals $R^2$, $R^3$ or $R^4$ is a $C_8$ to $C_{24}$ acyl radical x, y, z independently of one another are an integer from 0 to 50 with the proviso that x+y+z is an integer from 1 to 100, in the weight ratio of 99:1 to 1:99.

16. A process as claimed in claim 4, wherein X is Cl or $CH_3SO_4$.

* * * * *